United States Patent [19]

Peytavin

[11] 4,154,079

[45] May 15, 1979

[54] INTERMITTENT ROLLING MILL

[75] Inventor: Pierre Peytavin, Neuilly, France

[73] Assignee: Vallourec (Usines a Tubes de Lorraine-Escaut et Vallourec Reunies), Paris, France

[21] Appl. No.: 871,457

[22] Filed: Jan. 23, 1978

[30] Foreign Application Priority Data

Feb. 3, 1977 [FR] France ..... 77 03031

[51] Int. Cl.[2] ..... B21B 21/00

[52] U.S. Cl. ..... 72/214; 72/249

[58] Field of Search ..... 72/208, 209, 214, 252, 72/249

[56] References Cited

U.S. PATENT DOCUMENTS

| | | | |
|---|---|---|---|
| 1,810,698 | 6/1931 | Diescher | 72/189 |
| 2,560,934 | 7/1951 | Coe | 72/249 X |
| 3,698,225 | 10/1972 | Peytavin | 72/208 |

*Primary Examiner*—Milton S. Mehr

*Attorney, Agent, or Firm*—Brisebois & Kruger

[57] ABSTRACT

A pilgrim step rolling mill in which a carriage for advancing the product to be rolled toward the roller cage is driven intermittently in synchronism with the reciprocation of the roller cage by a screw which is both reciprocated axially and continuously rotated. The carriage advances to drive the product only in response to axial movement of the screw in one direction. The overall mill arrangement reduces the number of and extent of the gearing required.

7 Claims, 3 Drawing Figures

INTERMITTENT ROLLING MILL

SUMMARY OF THE INVENTION

This invention is related to application in France No. 77 03031, filed Feb. 3, 1977 and the disclosure thereof is incorporated herein by reference.

The present invention relates to a rolling mill of the pilgrim step or intermittent type having a device to rotate the product to be rolled, and a feed mechanism to axially displace the product to be rolled between two successive rolling passes.

Modern pilgrim step or intermittent rolling mills use high rolling cadences which require the product to be rolled to be displaced in a relatively short period of time and at a very precise instant.

The applicant has already proposed in U.S. Pat. No. 3,698,225 a pilgrim step rolling mill having a device for rotating the product to be rolled and a device for axial feed of this product, the rotating device including a shaft driven in continuous rotation synchronously with the oscillation of a roll cage and connected to means which transform this continuous rotation into an intermittent rotation imparted to the product to be rolled, the continuous rotation being transmitted to at least one means for transforming continuous rotation to intermittent rotation, namely, a FERGUSON type screw and tangent wheel mechanism placed near an associated gripper, each gripper transmitting intermittent rotations to the product to be rolled and each of the transforming means driving only the gripper which is associated with it.

The above patent also describes a device for intermittent axial driving of the product to be rolled, the driver being pivoted periodically by a cam and causing the periodic axial displacement of the product to be rolled.

In the rolling mill described in the above patent, a longitudinal shaft of the rotating device and the cam of the axial feed device are driven by a grooved shaft parallel to the longitudinal shaft and going through the carriage which supports the product to be rolled.

The present invention relates to a rolling mill comprising a device of the type described in the above patent for rotating the product to be rolled, and comprising an improved device for axial advance of the product to be rolled which provides a rolling mill of a simpler construction, notably by eliminating the grooved shaft used to rotationally drive the longitudinal shaft and the cam.

The rolling mill of the invention is also of simpler construction than the "MANNESMANN-MEER" type rolling mills, with respect to which it has the advantage of considerably reducing the number of gears necessary to transmit the different movements.

An object of the present invention is to provide, as a new industrial product, an intermittent or pilgrim step rolling mill comprising a device for rotating the product to be rolled and including a longitudinal shaft parallel to the path of the product to be rolled, driven in continuous rotation by the motor controlling the oscillations of a roller cage and joined to a plurality of means for transforming continuous rotation to intermittent rotation, particularly, "FERGUSON" type screw and tangent wheel mechanisms, each of which transmit a discontinuous rotation to the rolled product by a gripper or clamp; and a mechanism for axially feeding the product to be rolled and comprising a carriage sliding on longitudinal guides of the rolling mill and mounted by a nut on a rotatable longitudinal screw extending parallel to the path of the product to be rolled, the screw being rotated by an hydraulic motor fed by fluid under pressure by a variable flow pump, characterized by the fact that the device for feeding the tube axially comprises a thrust assembly axially joined to the screw at its extremity near the roller cage, the said thrust cage permitting rotation of the screw and being periodically displaced axially in synchronism with the oscillations of the roller cage by the action of a rocking lever driven by a cam driven in continuous rotation from a gear box connected to the motor of the rolling mill, the gear box also transmitting continuous rotation to the longitudinal shaft for rotating the rpoduct to be rolled, and being positioned on the central part of the longitudinal shaft essentially at a right angle to the roller cage end of the screw, and preferably about one third of the length of the said shaft from its end nearest the roller cage.

According to the invention, at the end of the screw which is remote from the thrust assembly, there is a spring for pulling the screw axially away from the roller cage, after each of the reciprocating axial feed movements of the screw in the direction of the cage by the action of the rocking lever.

In a preferred embodiment of the invention means are provided to vary the amplitude of axial displacement of the thrust assembly joined to the end of the screw as a function of the rotating speed of the screw determined by the variable flow pump. For that purpose, the pivoting lever is, for example, connected at its other end to a sleeve which is able to slide along the rod supporting the roller in contact with the cam. In adjusting the position of the sleeve fastening the link to the rod, one thus modifies the amplitude of the rocking of the lever and consequently the amplitude of axial movement transmitted by the thrust assembly to the screw.

In order that the invention may be better understood, an illustrative non-limiting embodiment will now be described.

DETAILED DESCRIPTION

Figure 1:
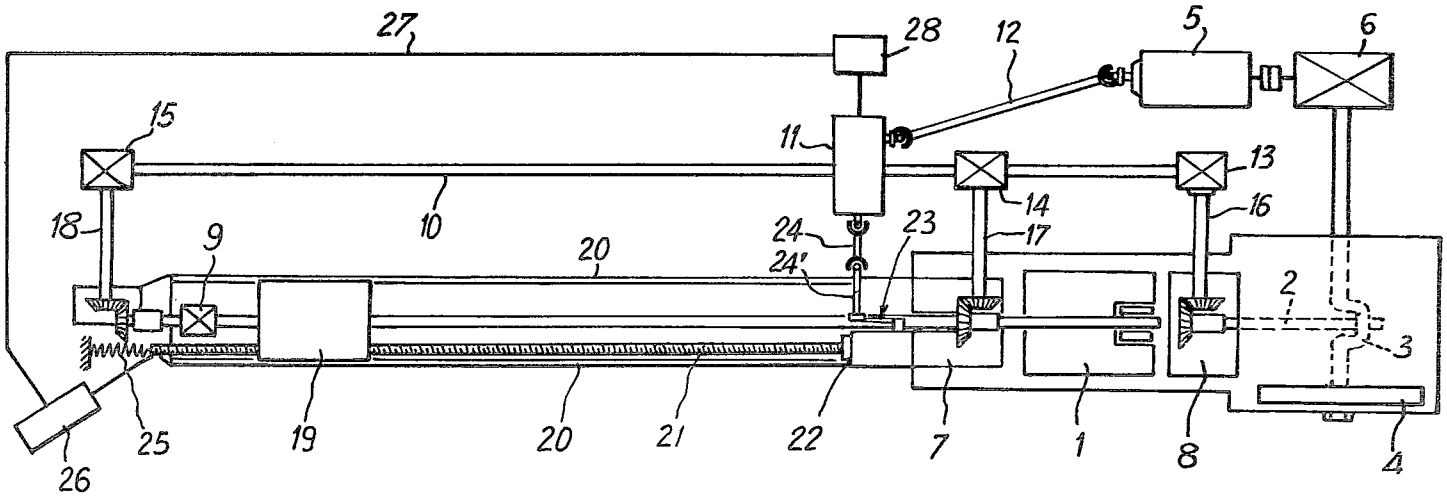
FIG. 1 is a plan view of the rolling mill of the invention.

The rolling mill shown in FIG. 1 is of a type which functions by a known process for rolling tubes, in accordance with which the thickness of the tube wall is reduced by rolling it between two rollers, while a mandrel whose diameter corresponds essentially to the internal diameter of the tube is held inside of the tube at the level of the rollers by a rod which projects from the rear of the tube. In this process it is necessary to transmit to the rod which supports the mandrel, the rotations which correspond to those imposed by the tube. However, the mandrel should not move axially in relation to the rolling mill.

The pilgrim step rolling mill shown in FIG. 1 comprises a roller cage 1 reciprocated by two connecting rods 2, joined to two cranks 3. The cranks are driven in synchronism in opposite directions by gears 4, from a motor unit 5, through gear box 6.

In FIG. 1 there are shown tube-grippers or clamps 7 and 8 on opposite sides of cage 1, which hold the tube in a conventional manner, during rolling, together with a rod-gripper or clamp 9 situated at the left end of the rolling mill and whose purpose is to hold the rod carrying the mandrel and impart to it successive rotations in synchronism with the rotations imparted to the tube-grippers 7 and 8.

FIG. 1 shows a longitudinal shaft 10 which is driven at a continuous rotating speed in synchronism with the reciprocation of the cage 1, by a gear box 11 connected to motor 5 by a universal jointed shaft 12. Gear box 11 is positioned on shaft 10 at a distance less than half the length of the shaft from cage 1, and as can be seen in the drawing, equal to about one-third of the length of the shaft from the cage.

Shaft 10 is connected to three "FERGUSON" gear boxes, 13, 14 and 15, which, for each revolution of shaft 10, rotate through a given angle the shafts 16, 17 and 18 which control the rotation of tube-grippers 7 and 8 and rod-gripper 9.

Such devices for imparting an intermittent rotation to the rolled product from a continuous rotation of a longitudinal shaft are described in applicants U.S. Pat. No. 3,698,225.

FIG. 1 also shows a carriage 19 sliding on slideway guides 20 fixed to the framework of the rolling mill. The carriage 19 is similar to the carriage disclosed in U.S. Pat. No. 3,698,225, and has an opening through which the mandrel rod extends, and an abutment which engages the end of the tube being rolled and causes the carriage to drive the tube axially when the carriage is moved toward roller cage 1. Carriage 19 is driven axially toward the cage, in a manner to be described later, by axial displacements of a screw 21 engaged with a nut held by carriage 19.

Figure 2:
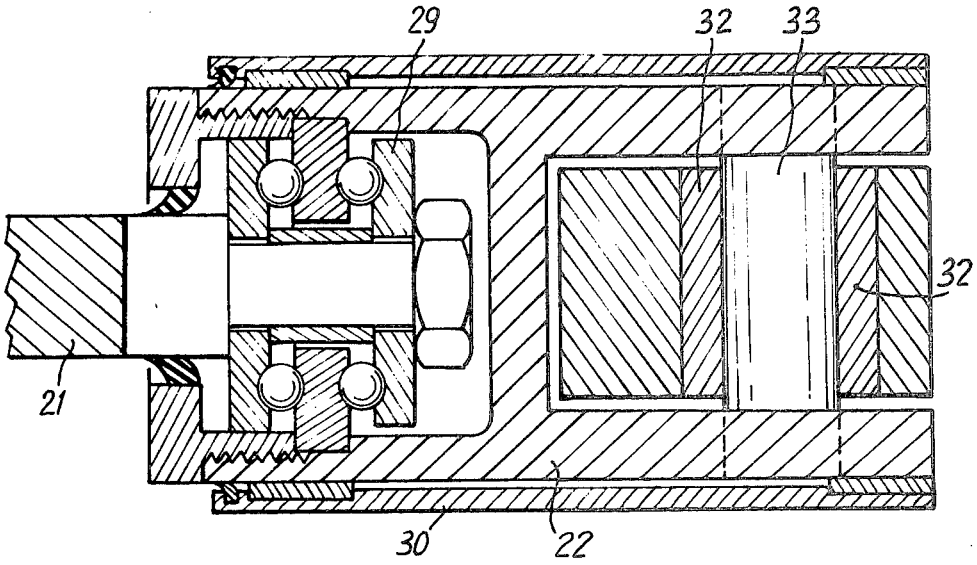
FIG. 2 is a view in section of the moveable thrust cage joined to the end of the longitudinal screw of the rolling mill of FIG. 1; and, FIG. 3 is a schematic view in elevation of the mechanism which transmits axial movements to the moveable thrust cage of FIG. 2.
Figure 3:
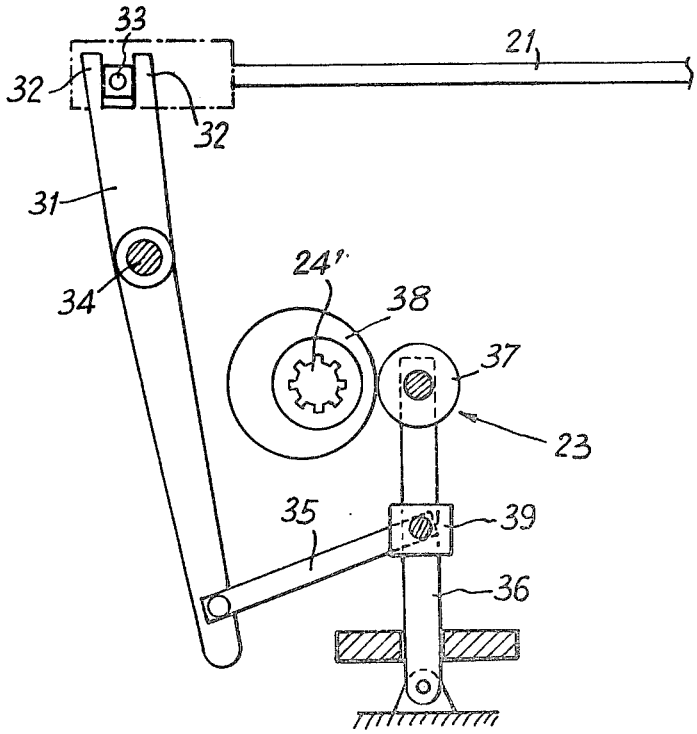

The end of screw 21 near the cage is fixed to an axially moveable thrust bearing assembly shown in detail at FIG. 2, this thrust assembly being displaced axially by the action of the cam and lever mechanism 23, shown at FIG. 3, and driven from gear box 11 by an universal jointed shaft 24 connected to a shaft 24' which drives the cam.

At its opposite end, remote from thrust assembly 22, the screw is fixed to a spring 25 which pulls the screw 21 away from cage 1.

Screw 21 is driven in continuous rotation by an hydraulic motor 26 fed through pipes 27 from a variable flow hydraulic pump 28 driven by gear box 11. It is understood that with such an arrangement, the speed of rotation of screw 21 is proportional to the speed of rotation of the motor, and consequently to the frequency of oscillation of the cage. The coefficient of proportionality is selected by varying the flow from pump 28. It is also desirable to provide a source of hydraulic fluid under pressure (not shown) for rapid return of the carriage 19 by rotating the hydraulic motor 26 in the reverse direction, after the end of one rolling operation of a product, for the placement of the next product.

Now refer to FIGS. 2 and 3 which show in detail an embodiment of the mechanism for axially displacing screw 21 and correspondingly, the carriage 19 which supports the product to be rolled. As shown at FIG. 2, screw 21 is fixed to the inner races of a thrust type ball bearing 29, which is itself fixed by its outer race to thrust cage 22. The bearing 29 connects the shaft 21 to thrust assembly 22 for axial movement of thrust assembly 22 and shaft 21 as a unit, but permits the shaft 21 to rotate. Thrust assembly 22 is constrained to slide axially in relation to an external fixed housing 30, which guides the assembly. The assembly is moved axially by the action of a rocking lever 31 having an upper extremity in the form of a fork 32 through which a transverse shaft 33 fixed to the thrust assembly 22 is inserted.

As can be ssen in FIG. 3 which shows the driving mechanism 23 for the thrust assembly 22, (indicated schematically at 23 of FIG. 1), lever 31 pivots on a fixed axis 34 and is pivotally connected near its lower extremity to one end of a link 35, itself pivotally connected at its other extremity to a rod 36 carrying at its upper extremity a roller 37 in contact with a cam 38. Cam 38 is continuously rotated by shaft 24' driven from gear box 11 by shaft 24.

The pivot point of link 35 in relation to rod 36 can be varied by sliding sleeve 39 to different positions along rod 36, and fixing the sleeve at a selected position.

One understands that with such a device, the continuous rotation of cam 38 is proporational to the speed of rotation of the motor because of the gear box 11, and is transformed into an oscillating movement of the lever 31, which in turn reciprocates screw 21 axially.

By the mechanism shown in FIG. 3, it is possible to make the amplitude of the axial movement in the direction of the cage of screw 21, vary, and it is also possible to control from the speed of rotation of cam 38, the speed of rotation of screw 21, by adjusting the flow from pump 28.

The functioning of the device which has just been described will now be explained briefly.

The rotation of motor 5, causing the reciprocating movement of roller cage 1 of the rolling mill, causes through shaft 12 and gear box 11, the continuous rotation of longitudinal shaft 10, and has been indicated, periodic rotations of the product to be rolled and of the mandrel supporting rod, in synchronism with the reciprocating movement of the cage. The tube-grippers 7 and 8 are such that they hold the product to be rolled in position axially when the tube is simply submitted to forces which result from rolling, but when the product to be rolled is driven axially by carriage 19 the tube-grippers permit this displacement.

Each of the axial displacements of the tube in the direction of cage 1 is caused by the rotation of cam 38 which makes lever 31 rock which, as has been indicated, causes an axial displacement of a predetermined length toward the roller cage, of screw 21 and thus carriage 19 which pushes the product to be rolled. Subsequently, screw 21 is brought back towards the left of FIG. 1 by spring 25, carriage 19 remaining immobile during this period which corresponds to the rolling of the portion of the product brought between the rollers during the preceding axial feed period.

After this backward return period of the screw, the next axial feed movement is transmitted to thrust assembly 22 and to screw 21 by the rotation of cam 38.

One can thus see that by the present invention it is possible to obtain in a simple and precise manner, with a relatively reduced number of parts, feed movements which it is necessary to impose on the product during rolling.

It is to be understood that the embodiment which has just been described is in no way limiting and that it could have any desirable modifications without going beyond the scope or the spirit of the invention.

I claim:

1. Intermittently acting rolling mill comprising a reciprocating roller cage, drive means for continuously rotating in a single direction a drive member, which member is connected to drive said roller cage through means for converting the continuous rotary motion of said drive member to reciprocating movement by said cage, shaft means substantially parallel to the direction of reciprocation of said cage and connected to be continuously driven in synchronism with said drive member, at least one rotatable clamp for gripping a product being rolled in said roller cage, a device through which said at least one clamp is driven from said shaft means, which device converts the continuous rotation of said shaft means to intermittent rotation by said at least one clamp in synchronism with the reciprocating movement of said cage, a carriage for supporting said product, and advancing means for intermittent advancing said carriage to intermittently advance the product in synchronism with the reciprocation of said cage, said advancing means comprising, a rocker arm, an elongated screw having its axis generally parallel to the direction of advance of the product, bearing means connecting one end of said screw to said arm for rotation and for axial reciprocation of the screw in response to rocking of said arm, means for continuously rotating said screw, means driven from said drive member for rocking said arm in synchronism with the reciprocation of said cage, nut means on said carriage and threadedly engaging said screw, and means for driving said carriage with said screw to advance the product, only in response to axial movement of the screw in one direction.

2. A rolling mill according to claim 1 wherein said means for rocking said arm comprises, a cam engaging said arm and driven by a gear box from said drive member.

3. A rolling mill according to claim 1 wherein said shaft means drives a gear box essentially at a right angle to and near said one end of said screw, said gear box driving said means for rocking said arm.

4. A rolling mill according to claim 3 wherein said gear box is positioned on said shaft at a location approximately one-third the length of the shaft from its end nearest the roller cage.

5. A rolling mill according to claim 1, further comprising a spring at a second end of the said screw to urge said screw away from the roller cage.

6. A rolling mill according to claim 1, further comprising means to vary the amplitude of axial displacement of said screw.

7. A rolling mill according to claim 6 wherein said means driving said rocker arm comprises a pivoting rod driven by a cam, a link pivotally connected to said rocker arm, and a sleeve adjustable along said rod and pivotally connecting said link to the rod.

* * * * *